United States Patent [19]

Kinstedt et al.

[11] Patent Number: 4,988,452

[45] **Date of Patent: * Jan. 29, 1991**

[54] LIQUID AUTOMATIC DISHWASHING DETERGENT COMPOSITIONS CONTAINING BLEACH-STABLE NONIONIC SURFACTANT

[75] Inventors: George C. Kinstedt, West Chester; Sherri L. Myers, Cincinnati, both of Ohio

[73] Assignee: The Procter & Gamble Company, Cincinnati, Ohio

[ * ] Notice: The portion of the term of this patent subsequent to Aug. 22, 2006 has been disclaimed.

[21] Appl. No.: 204,446

[22] Filed: Jun. 9, 1988

[51] Int. Cl.[5] ..... C11D 1/00

[52] U.S. Cl. ..... 252/99; 252/103; 252/174.22; 252/174.24; 252/DIG. 14

[58] Field of Search ..... 252/99, 174.22, DIG. 14, 252/103, 174.24

[56] References Cited

U.S. PATENT DOCUMENTS

| | | | |
|---|---|---|---|
| 2,674,619 | 4/1954 | Lundsted | 260/485 |
| 2,677,700 | 5/1954 | Jackson et al. | 260/488 |
| 2,979,528 | 4/1961 | Lundsted | 260/584 |
| 3,036,118 | 5/1962 | Jackson et al. | 260/484 |
| 3,048,548 | 8/1962 | Martin et al. | 252/135 |
| 3,255,117 | 6/1966 | Knapp et al. | 252/99 |
| 3,314,891 | 4/1967 | Schmolka et al. | 252/89 |
| 3,352,785 | 11/1967 | Corliss et al. | 252/99 |
| 3,899,387 | 8/1975 | Freis et al. | 162/158 |
| 4,006,091 | 2/1977 | Lindblom et al. | 252/90 |
| 4,095,035 | 6/1978 | Lamberti et al. | 560/180 |
| 4,147,650 | 4/1979 | Sabatelli et al. | 252/103 |
| 4,215,004 | 7/1980 | Borgerding et al. | 252/156 |
| 4,226,736 | 10/1980 | Bush et al. | 252/135 |
| 4,240,919 | 12/1980 | Chapman | 252/95 |
| 4,436,637 | 3/1984 | Ramachandran et al. | 252/8.7 |
| 4,491,539 | 1/1985 | Hoskins et al. | 252/541 |
| 4,522,740 | 6/1985 | Schmid et al. | 252/174.21 |
| 4,548,729 | 10/1985 | Schmid et al. | 252/174.21 |
| 4,608,188 | 8/1986 | Parker et al. | 252/99 |
| 4,624,803 | 11/1986 | Balzer et al. | 252/527 |
| 4,661,280 | 4/1987 | Ouhadi et al. | 252/99 |
| 4,686,254 | 8/1987 | Lochhead et al. | 524/99 |
| 4,703,114 | 10/1987 | Mori et al. | 536/4.1 |
| 4,726,909 | 2/1988 | Otten et al. | 252/174.21 |
| 4,740,327 | 4/1988 | Julemont et al. | 252/103 |
| 4,752,409 | 6/1988 | Drapier et al. | 252/94 |
| 4,859,358 | 8/1989 | Gabriel | 252/99 |
| 4,889,653 | 12/1989 | Ahmed | 252/99 |

FOREIGN PATENT DOCUMENTS

| | | |
|---|---|---|
| 0082564 | 6/1983 | European Pat. Off. . |
| 197434 | 10/1986 | European Pat. Off. . |
| 0239379 | 9/1987 | European Pat. Off. . |
| 264826 | 4/1988 | European Pat. Off. . |
| 0264975 | 4/1988 | European Pat. Off. . |
| 264975 | 4/1988 | European Pat. Off. . |
| 2615698 | 10/1977 | Fed. Rep. of Germany . |
| 2854484 | 6/1980 | Fed. Rep. of Germany . |
| 62-032198 | 2/1987 | Japan . |
| 63-061093 | 3/1988 | Japan . |
| 1527706 | 10/1978 | United Kingdom . |
| 2048841 | 12/1980 | United Kingdom . |
| 3023828 | 2/1982 | United Kingdom . |
| 2116199 | 9/1983 | United Kingdom . |
| 2140450 | 11/1984 | United Kingdom . |
| 2164350 | 3/1986 | United Kingdom . |
| 2176495 | 12/1986 | United Kingdom . |
| 2185037 | 7/1987 | United Kingdom . |
| 2193724 | 2/1988 | United Kingdom . |
| 2194954 | 3/1988 | United Kingdom . |
| 2196972 | 5/1988 | United Kingdom . |

OTHER PUBLICATIONS

U.S. Serial No. 163,172, Roselle, filed Feb. 26, 1988.
U.S. Serial No. 204,445, Prince et al, filed Jun. 9, 1988.
U.S. Ser. No. 204,444, Gabriel et al, filed Jun. 9, 1988.
Product Literature for Carbopol 600 Series from B. F. Goodrich Company.

*Primary Examiner*—John F. Niebling
*Assistant Examiner*—Isabelle R. McAndrews
*Attorney, Agent, or Firm*—Gretchen B. Hatfield; Donald E. Hasse; Thomas H. O'Flaherty

[57] ABSTRACT

Thickened aqueous automatic dishwashing detergent compositions comprising certain bleach-stable capped polyalkylene oxide block copolymer nonionic surfactants.

21 Claims, No Drawings

LIQUID AUTOMATIC DISHWASHING DETERGENT COMPOSITIONS CONTAINING BLEACH-STABLE NONIONIC SURFACTANT

Technical Field and Background Art

This invention relates to aqueous automatic dishwashing detergent compositions which have a yield value and are shear-thinning. Compositions of this general type are known. Examples of such compositions are disclosed in Rupe et al U.S. Pat. No. 4,116,851, issued Sept. 26, 1978; Ulrich U.S. Pat. No. 4,431,559, issued Feb. 14, 1984; Pruhs et al U.S. Pat. No. 4,511,487, issued Apr. 16, 1985; Heile U.S. Pat. No. 4,512,908, issued Apr. 23, 1985; Bush et al Canadian Patent No. 1,031,229; Heile European Patent Application No. 0130678, published Jan. 9, 1985; Robinson European Patent Application No. 0176163, published Apr. 2, 1986; Julemont et al UK Patent Application 2,116,199A, published Sept. 21, 1983; Julemont et al UK Patent Application No. 2,140,450A, published Nov. 29, 1984; Colarusso UK Patent Application No. 2,163,447A, published Feb. 26, 1986; and Lai et al UK Patent Application No. 2,164,350A, published Mar. 19, 1986.

Nonionic surfactants are generally not stable in the presence of chlorine bleach. Hence, state of the art liquid automatic dishwashing detergent compositions generally do not comprise nonionic surfactants. Furthermore, the state of the art liquid automatic dishwashing detergent compositions typically thickened with clay still suffer from phase separation upon storage under certain conditions. Phase separation is an even greater problem with nonionic surfactants. Such compositions are improved by the utilization of a polycarboxylate thickener and a phosphate ester stabilizer for improved phase stability and cohesiveness, as described herein.

The use of polyacrylic thickeners in liquid automatic dishwashing detergent compositions is known. See, for example, Dixit U.K. Patent Application No. 2,185,037, published July 8, 1987, which discloses liquid automatic dishwashing detergents which contain a long chain carboxylic or polycarboxylic acid as the thickener. Also, Brumbaugh European Patent Application No. 0239379, published Sept. 9, 1987, teaches that polyacrylate is useful for water spot reduction in liquid automatic dishwashing detergent compositions. Bush et al U.S. Pat. No. 4,226,736, issued Oct. 7, 1980, teaches that a polymer of acrylic acid can be used as a thickener in liquid automatic dishwashing detergents instead of clay.

The use of phosphate esters, in general, in automatic dishwashing detergent compositions is also known. See, for example, Julemont et al U.K. Patent Application No. 2,116,199, published Sept. 21, 1983, which teaches the use of an alkyl ester of phosphoric acid as a foam depressor.

The combination of polyacrylate thickeners and phosphate ester plus clay has also been taught in Lai et al U.K. Patent Application No. 1,164,350, published Mar. 19, 1986. The polyacrylate thickeners taught to be useful have molecular weights of up to 500,000 (preferably up to 50,000). These compositions are said to be useful for protection of glazing on fine china.

It has now been found that certain capped polyalkylene oxide block copolymer nonionic surfactants are relatively stable in the presence of chlorine bleach in liquid automatic dishwashing compositions. When such compositions further comprise the preferred polyacrylate thickener and phosphate ester together in the absence of clay, bleach stability, enhanced phase stability, improved spotlessness, and reduction of filming are achieved, as well as improved dispensing of the product from its container.

SUMMARY OF THE INVENTION

The compositions of this invention are liquid automatic dishwashing detergent compositions comprising:

1. hypochlorite bleach to yield available chlorine in an amount of from about 0.1% to about 5%;
2. from about 0.1% to about 5% of a nonionic surfactant having the following structure:

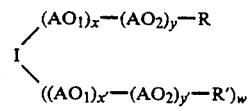

wherein I is the residue of a compound selected from the group consisting of a monohydroxyl compound, a dihydroxyl compound, and a polyhydroxyl compound; $AO_1$ and $AO_2$ are oxyalkyl groups and one of $AO_1$ and $AO_2$ is propylene oxide with the corresponding x or y being greater than zero, and the other of $AO_1$ and $AO_2$ is ethylene oxide with the corresponding responding x or y being greater than zero, and the molar ratio of propylene oxide to ethylene oxide is from about 2:1 to about 8:1; R and R are selected from the group consisting of alkyl aryl, aryl alkyl, alkyl, aryl, cycloalkyl, and mixtures thereof; w is less than 8, preferably equal to zero or one; and x' and y, are greater than or equal to zero.

DETAILED DESCRIPTION OF THE INVENTION

Bleach-Stable Detergent Surfactants

The compositions of this invention contain from about 0.1% to about 5%, preferably from about 0.2% to about 3%, of a bleach-stable capped polyalkylene oxide block copolymer nonionic detergent surfactant.

Since the compositions of the present invention contain hypochlorite bleach, the detergent surfactant must be bleach-stable. Such a surfactant desirably does not contain functions such as unsaturation and some aromatic, amide, aldehydic, methyl keto or hydroxyl groups which are susceptible to oxidation by the hypochlorite. The capped polyalkylene oxide block copolymer nonionic surfactants provide bleach stability. It is believed that the capping function makes the compounds of the present invention less susceptible to oxidation by the hypochlorite. Bleach-stable nonionic surfactants of the present invention are capped polyalkylene oxide block copolymer surfactants of the following structure:

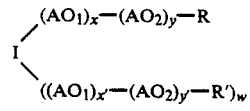

where I is the residue of a monohydroxyl, dihydroxyl, or a polyhydroxyl compound; $AO_1$ and $AO_2$ are oxyalkyl groups and one of $AO_1$ and $AO_2$ is propylene oxide with the corresponding x or y being greater than zero, and the other of $AO_1$ and $AO_2$ is ethylene oxide with the corresponding x or y being greater than zero, and the molar ratio of propylene oxide to ethylene oxide is from about 2:1 to about 8:1; R and R′ are selected from the groups consisting of alkyl, aryl, alkyl aryl, aryl alkyl, cycloalkyl, and mixtures thereof; w is less than 8, preferably equal to zero or one; and x′ and y′ are greater than or equal to zero.

Preferably the oxyalkyl groups are oxypropyl, oxyethyl, and mixtures thereof; I is the residue of an alcohol group, an alkyl phenol group, or a dialkyl phenol group, preferably methanol, ethanol, or butanol, or I is the residue of ethylene glycol, propylene glycol, butylene glycol, bisphenol, glycerine, or trimethylolpropane; and R and R′ are selected from the group consisting of $C_1$–$C_8$ alkyl, alkyl aryl with an alkyl chain length of $C_1$–$C_8$, aryl alkyl with an alkyl chain length of $C_1$–$C_8$, aryl and mixtures thereof. More preferably R and R′ are $C_1$–$C_4$ alkyl groups. Most preferably R and R′ are methyl groups. Also preferred in the compounds of this general formula, $AO_1$ is propylene oxide and $AO_2$ is ethylene oxide, and the molar ratio of total propylene oxide to total ethylene oxide is from about 3:1 to about 6:1. Alternatively, compounds of this general formula in which $AO_2$ is propylene oxide and $AO_1$ is ethylene oxide, and the molar ratio of total propylene oxide to total ethylene oxide is from about 3:1 to about 6:1 are preferred.

Of these compounds, the following structures are preferred:

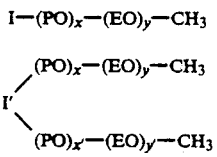

These compounds preferably have molecular weights ranging from about 1000 to about 4000. In these structures I is the residue of a monohydroxyl compound, preferably the residue of methanol, ethanol, or butanol, and I is the residue of a dihydroxyl compound, preferably ethylene glycol, propylene glycol, or butylene glycol. Also, EO is an ethylene oxide group; PO is a propylene oxide group; x and x are the number of propylene oxide groups; and y and y′ are the number of ethylene oxide groups. Also, x, y, x′, and y, are each greater than zero, and the ratio of x to y and x′ to y′ is from about 3:1 to about 6:1.

The above structures in which the (EO)y and (PO)x sequencing order are reversed are also useful in the present invention. In these reverse structures, y and y′ are the number of propylene oxide groups; x and x, are the number of ethylene oxide groups; and the ratio of y to x and y′ to x′ is from about 3:1 to about 6:1.

Most preferably the nonionic surfactant is of the following formula:

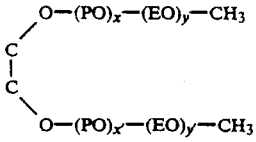

having a molecular weight of about 1800 to about 2000 (preferably 1900), wherein PO is propylene oxide, EO is ethylene oxide, and the molar ratio of PO to EO is from about 4:1 to about 5:1. The surfactant is not only bleach-stable, but it provides low sudsing and superior performance in reducing spotting and filming as well.

Bleaching Agent

The instant compositions also include a bleaching agent which yields a hypochlorite species in aqueous solution. The hypochlorite ion is chemically represented by the formula $OCl^-$. The hypochlorite ion is a strong oxidizing agent, and for this reason materials which yield this species are considered to be powerful bleaching agents.

The strength of an aqueous solution containing hypochlorite ion is measured in terms of available chlorine. This is the oxidizing power of the solution measured by the ability of the solution to liberate iodine from an acidified iodide solution. One hypochlorite ion has the oxidizing power of 2 atoms of chlorine, i.e., one molecule of chlorine gas.

At lower pH levels, aqueous solutions formed by dissolving hypochlorite-yielding compounds contain active chlorine, partially in the form of hypochlorous acid moieties and partially in the form of hypochlorite ions. At pH levels above about 10, i.e., at the preferred pH levels of the instant compositions, essentially all of the active chlorine is in the form of hypochlorite ion.

Those bleaching agents which yield a hypochlorite species in aqueous solution include alkali metal and alkaline earth metal hypochlorites, hypochlorite addition products, chloramines, chlorimines, chloramides, and chlorimides. Specific examples of compounds of this type include sodium hypochlorite, potassium hypochlorite, monobasic calcium hypochlorite, dibasic magnesium hypochlorite, chlorinated trisodium phosphate dodecahydrate, potassium dichloroisocyanurate, sodium dichloroisocyanurate, sodium dichloroisocyanurate dihydrate, trichlorocyanuric acid, 1,3-dichloro-5,5-dimethylhydantoin, N-chlorosulfamide, Chloramine T, Dichloramine T, Chloramine B and Dichloramine B. A preferred bleaching agent for use in the compositions of the instant invention is sodium hypochlorite.

Most of the above-described hypochlorite-yielding bleaching agents are available in solid or concentrated form and are dissolved in water during preparation of the compositions of the instant invention. Some of the above materials are available as aqueous solutions.

The above-described bleaching agents are dissolved in the aqueous liquid component of the present composition. Bleaching agents can provide from about 0.1% to 5% available chlorine by weight, preferably from about 0.5% to 2.0% available chlorine by weight, of the total composition.

Buffering Agent

In the instant compositions, it is generally desirable to also include one or more buffering agents capable of maintaining the pH of the instant compositions within the alkaline range. Preferably the pH range is from about 10.5 to about 12.5. It is in this pH range that optimum performance of the bleach and surfactant are realized, and it is also within this pH range wherein optimum composition chemical stability is achieved.

Maintenance of this particular pH range minimizes the chemical interaction between the strong hypochlorite bleach and the surfactant compounds present in the instant compositions. Finally, as noted, high pH values such as those maintained by an optional buffering agent serve to enhance the soil and stain removal properties during utilization of the present compositions.

Any compatible material or mixture of materials which has the effect of maintaining the composition pH within the alkaline pH range, and preferably within the 10.5 to 12.5 range, can be utilized as the buffering agent in the instant invention. Such materials can include, for example, various water-soluble, inorganic salts such as the carbonates, bicarbonates, sesquicarbonates, silicates, pyrophosphates, phosphates, tetraborates, and mixtures thereof. Examples of materials which can be used either alone or in combination as the buffering agent herein include sodium carbonate, sodium bicarbonate, potassium carbonate, sodium sesquicarbonate, sodium silicate, sodium pyrophosphate, tetrapotassium pyrophosphate, tripotassium phosphate, trisodium phosphate, anhydrous sodium tetraborate, sodium tetraborate pentahydrate, potassium hydroxide, sodium hydroxide, and sodium tetraborate decahydrate. Preferred buffering agents for use herein comprise from about 4% to about 10% sodium silicate, from about 0.5% to about 1.5% sodium hydroxide, and mixtures thereof. Buffering agents for use herein may include mixtures of tetrapotassium pyrophosphate and trisodium phosphate in a pyrophosphate/phosphate weight ratio of about 3:1, mixtures of tetrapotassium pyrophosphate and tripotassium phosphate in a pyrophosphate/phosphate weight ratio of about 3:1, and mixtures of anhydrous sodium carbonate and sodium silicate in a carbonate/silicate weight ratio of about 1:3 to about 3:1, preferably from about 1:2 to about 2:1.

If present, the above-described buffering agent materials are dissolved or suspended in the aqueous liquid component. Buffering agents can generally comprise from about 2% to 20% by weight, preferably from about 5% to 15% by weight, of the total composition.

Detergency Builder

Detergency builders are desirable materials which reduce the free calcium and/or magnesium ion concentration in a surfactant-containing aqueous solution. They are used herein at a level of from about 5% to about 40%, preferably from about 15% to about 30%. The preferred detergency builder for use herein is sodium tripolyphosphate in an amount from about 10% to about 40%, preferably from about 20% to about 30%. Generally a certain percentage of the sodium tripolyphosphate is in an undissolved particulate form suspended in the rest of the detergent composition.

Other detergency builders include potassium pyrophosphate, sodium pyrophosphate, potassium tripolyphosphate, potassium hexametaphosphate, and alkali metal carbonates such as sodium carbonate.

Some of the above-described buffering agent materials additionally serve as builders. It is preferred that the buffering agent contain at least one compound capable of additionally acting as a builder. Polycarboxylate Polymer The compositions of the present invention preferably comprise a high molecular weight polycarboxylate polymer thickener. By "high molecular weight" is meant from about 500,000 to about 5,000,000, preferably from about 750,000 to about 4,000,000.

The polycarboxylate polymer may be a carboxyvinyl polymer. Such compounds are disclosed in Brown U.S. Pat. No. 2,798,053, issued on July 2, 1957, the specification of which is hereby incorporated by reference. Methods for making carboxyvinyl polymers are also disclosed in Brown.

A carboxyvinyl polymer is an interpolymer of a monomeric mixture comprising a monomeric olefinically unsaturated carboxylic acid, and from about 0.1% to about 10% by weight of the total monomers of a polyether of a polyhydric alcohol, which polyhydric alcohol contains at least four carbon atoms to which are attached at least three hydroxyl groups, the polyether containing more than one alkenyl group per molecule. Other monoolefinic monomeric materials may be present in the monomeric mixture if desired, even in predominant proportion. Carboxyvinyl polymers are substantially insoluble in liquid, volatile organic hydrocarbons and are dimensionally stable on exposure to air.

Preferred polyhydric alcohols used to produce carboxyvinyl polymers include polyols selected from the class consisting of oligosaccarides, reduced derivatives thereof in which the carbonyl group is converted to an alcohol group, and pentaerythritol; more preferred are oligosaccharides, most preferred is sucrose. It is preferred that the hydroxyl groups of the polyol which are modified be etherified with allyl groups, the polyol having at least two allyl ether groups per polyol molecule. When the polyol is sucrose, it is preferred that the sucrose have at least about five allyl ether groups per sucrose molecule. It is preferred that the polyether of the polyol comprise from about 0.1% to about 4% of the total monomers, more preferably from about 0.2% to about 2.5%.

Preferred monomeric olefinically unsaturated carboxylic acids for use in producing carboxyvinyl polymers used herein include monomeric, polymerizable, alpha-beta monoolefinically unsaturated lower aliphatic carboxylic acids; more preferred are monomeric monoolefinic acrylic acids of the structure $$CH_2{=}\overset{\overset{\displaystyle R}{|}}{C}{-}COOH$$

where R is a substituent selected from the group consisting of hydrogen and lower alkyl groups; most preferred is acrylic acid.

Carboxyvinyl polymers useful in formulations of the present invention have a molecular weight of at least about 750,000; preferred are highly cross-linked carboxyvinyl polymers having a molecular weight of at least about 1,250,000; also preferred are carboxyvinyl polymers having a molecular weight of at least about 3,000,000 which may be less highly cross-linked.

Various carboxyvinyl polymers are commercially available from B. F. Goodrich Company, New York, N.Y., under the tradename Carbopol. Carboxyvinyl polymers useful in formulations of the present invention include Carbopol 910 having a molecular weight of about 750,000, preferred Carbopol 941 having a molecular weight of about 1,250,000, and more preferred Carbopols 934 and 940 having molecular weights of about 3,000,000 and 4,000,000, respectively.

Carbopol 934 is a very slightly cross-linked carboxyvinyl polymer having a molecular weight of about 3,000,000. It has been described as a high molecular weight polyacrylic acid cross-linked with about 1% of polyallyl sucrose having an average of about 5.8 allyl groups for each molecule of sucrose.

Additional polycarboxylate polymers useful in the present invention are Sokalan PHC-25R' a polyacrylic acid available from BASF Corp. and Gantrez ®, a poly (methyl vinyl ether/maelic acid) interpolymer available from GAF.

Preferred polycarboxylate polymers of the present invention are non-linear, water-dispersible polyacrylic acid cross-linked with a polyalkenyl polyether and having a molecular weight of from about 750,000 to about 4,000,000. Highly preferred examples of these polycarboxylate polymer thickeners for use in the present invention are the Carbopol 600 series resins available from B. F. Goodrich. Especially preferred are Carbopol 616 and 617. It is believed that these resins are more highly cross-linked than the 900 series resins and have molecular weights between 1,000,000 and 4,000,000.

Mixtures of polycarboxylate polymers as herein described may also be used in the present invention. Particularly preferred is a mixture of Carbopol 616 and 617 series resins.

The nonionic surfactant and polycarboxylate polymer thickener of the present invention are preferably utilized with essentially no clay thickening agents. In fact, it has been found that if the nonionic surfactant and polycarboxylate polymer of the present invention are utilized with clay in the composition of the present invention, a much less desirable product results in terms of phase instability. A trace amount of clay may be acceptable, preferably less than 0.05% clay. The polycarboxylate polymer is preferably used instead of clay as a thickening/stabilizing agent in the present compositions.

The polycarboxylate polymer also provides a reduction in what is commonly called "bottle hang-up". This term refers to the inability to dispense all of the dishwashing detergent product from its container. Without wishing to be bound by theory, it is believed that the compositions of the present invention provide this benefit because the force of cohesion of the composition is greater than the force of adhesion to the container wall. With clay thickener systems, which most commercially available products contain, bottle hang-up can be a significant problem under certain conditions.

Without wishing to be bound by theory, it is also believed that the long chain molecules of the polycarboxylate polymer thickener help to suspend solids in the detergent compositions of the present invention and help to keep the matrix expanded. The polymeric material is also less sensitive than clay thickeners to destruction due to repeated shearing, such as occurs when the composition is vigorously mixed.

From about 0.1% to about 10%, preferably from about 0.2% to about 2%, of the high molecular weight polycarboxylate polymer is used in the composition of the present invention.

The polymeric thickener is utilized to provide a yield value of from about 50 to about 350, and most preferably from about 75 to about 300.

Yield Value Analysis

The yield value is an indication of the shear stress at which the gel strength is exceeded and flow is initiated. It is measured herein with a Brookfield RVT model viscometer with a T-bar B spindle at 25° C. utilizing a Helipath drive upward during associated readings. The system is set to 0.5 RPM and a reading is taken for the composition to be tested after 30 seconds or after the system is stable. The system is stopped and the RPM is reset to 1.0 RPM. A reading is taken for the same composition after 30 seconds or after the system is stable. Stress at zero shear is equal to two times the 0.5 RPM reading minus the reading at 1.0 RPM. The yield value is calculated as the stress at zero shear times 18.8 (conversion factor).

Phosphate Ester

The compositions of the present invention may also comprise an ester of phosphoric acid (phosphate ester) for enhanced stability. Phosphate esters are any materials of the general formula:

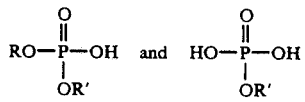

wherein R and R′ are $C_6$–$C_{20}$ alkyl or ethoxylated alkyl groups of the general formula: alkyl—$(OCH_2CH_2)Y$ wherein the alkyl substituent is $C_6$–$C_{20}$ and Y is between 0 and about 4. Most preferably the alkyl substituent of that formula is $C_{12}$–$C_{18}$ and y is between about 2 and about 4. Such compounds are prepared by known methods from phosphorus pentoxide, phosphoric acid, or phosphorus oxy halide and alcohols or ethoxylated alcohols.

It will be appreciated that the formula depicted represent mono- and di-esters, and commercial phosphate esters will generally comprise mixtures of the mono- and di-esters, together with some proportion of tri-ester. Typical commercial esters are available under the trademarks "Phospholan" PDB3 (Diamond Shamrock), "Servoxyl" VPAZ (Servo), PCUK-PAE (BASF-Wyandotte), and SAPC (Hooker). Preferred for use in the present invention are KW340N and KL340N (Hoescht) and monostearyl acid phosphate (Oxidental Chemical Corp.). Most preferred for use in the present invention is Hostophat-TP-2253 (Hoescht).

The phosphate ester component aids in control of specific gravity of the detergent products of the present invention. The phosphate ester also helps to maintain stability of the product.

The phosphate esters useful herein also provide protection of silver and silver-plated utensil surfaces. The phosphate ester component also acts as a suds suppressor; thus an additional suds suppressor is not required in the surfactant-containing detergent compositions disclosed herein.

These phosphate esters in combination with the polycarboxylate polymer thickener provide enhanced stability to the liquid automatic dishwashing detergent compositions of the present invention. More specifically, the phosphate ester component helps to keep the solid particles in the compositions of the present invention in suspension. Thus, the combination inhibits the separation out of a liquid layer from compositions of this type.

From about 0.1% to about 5%, preferably from about 0.15% to about 1.0% of the phosphate ester component may be used in the compositions of the present invention.

Entrained Gas

Optionally, the compositions of the present invention may comprise entrained gas to further ensure stability.

The entrained gas can be any gaseous material that is insoluble in the aqueous liquid. Air is preferred, but any gas that will not react with the composition, such as nitrogen, is also useful.

The entrained gas bubbles are preferably in very finely divided form, preferably less than about 1/32 in. in diameter. They are dispersed throughout the aqueous liquid in an amount, generally from about 1% to about 20%, preferably from about 5% to about 15% by volume, to lower the specific gravity of the overall composition to within from about 5% more than to about 10% less than, preferably within from about 1% more than to about 5% less than the specific gravity of the aqueous liquid without the entrained gas. It is more desirable to be below the specific gravity of the aqueous phase. Any phase separation is then at the bottom of the container, and pouring will tend to remix the separated phase before it is dispensed.

The gas can be admixed with high shear mixing, e.g., through a shear device that has close tolerances to achieve air bubble size reduction. High shear mixing can be attained with shear rates greater than about 1000 sec-1, preferably greater than about 15,000 sec-1, most preferably greater than 30,000 sec-1. The polycarboxylate polymer, on the other hand, should preferably be added last to minimize excessive exposure to shear. Each of these preferred processing steps gives compositions with superior stability. The gas can also be introduced in finely divided form by using a sparger.

Hydroxy Fatty Acid Salt

Because automatic dishwashing detergent compositions contain bleach, sterling or silver-plated flatware can become tarnished after repeated exposures to the harsh composition. Metal salts of long chain hydroxy fatty acids have been found to be useful in automatic dishwashing detergent compositions of this type to inhibit said tarnishing. By "long chain hydroxy fatty acid" is meant the higher aliphatic hydroxy fatty acids having from about 8 to about 22 carbon atoms, preferably from about 10 to 20 carbon atoms, and most preferably from about 12 to 18 carbon atoms, inclusive of the carbon atom of carboxyl group of the fatty acid. Hydroxy stearic acid is especially preferred. By "metal salts" of the long chain hydroxy fatty acids is meant both monovalent and polyvalent metal salts particularly the sodium, potassium, lithium, aluminum and zinc salts. Particularly preferred is the lithium salts of the hydroxy fatty acids. Specific examples of the preferred materials are potassium, sodium and particularly lithium hydroxy stearate. The compounds are compatable with bleach and other components traditionally found in automatic dishwashing detergent compositions. These compounds are essentially insoluble in water. Because of the presence of the hydroxy group in these compounds, they do not significantly affect viscosity of the compositions of the present invention. Thus, the hydroxy fatty acid salts are useful in connection with thickening agents such as clay or polycarboxylate thickeners in automatic dishwashing detergent compositions. The metals salts of long chain hydroxy fatty acids may optionally be incorporated into the automatic dishwashing detergent compositions of the present invention at from about 0.05% to about 0.3%, preferably from about 0.05% to about 0.2%, by weight of the detergent composition.

Other Optional Materials

Conventional coloring agents and perfumes can also be added to the instant compositions to enhance their aesthetic appeal and/or consumer acceptability. These materials should, of course, be those dye and perfume varieties which are especially stable against degradation by high pH and/or strong active chlorine bleaching agents.

If present, the above-described other optional materials generally comprise no more than about 10% by weight of the total composition and are dissolved, suspended, or emulsified in the present compositions

Preferred Composition

Preferred compositions of this invention are liquid automatic dishwasher detergent compositions comprising:

(1) from about 15% to about 25% of sodium tripolyphosphate;
(2) from about 4% to about 10% of sodium silicate;
(3) from about 3% to about 10% of sodium carbonate;
(4) hypochlorite bleach in an amount to provide from about 0.5% to about 1.5% of available chlorine;
(5) from about 0.2% to about 2% of a polycarboxylate polymer thickening agent selected from the group consisting of polycarboxylate polymers comprising non-linear, water-dispersible polyacrylic acid cross-linked with a polyalkenyl polyether having a molecular weight of from about 750,000 to about 4,000,000, and mixtures thereof;
(6) from about 0.15% to about 1% of an ethoxylated alkyl ester of phosphoric acid having an average alkyl chain length of from about 12 to about 18 carbon atoms and an average number of ethoxylate units of from about 2 to about 4; and
(7) from about 0.5% to about 2% of a nonionic surfactant having the following structure:

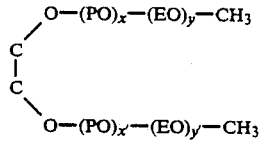

and having a molecular weight of about 1900, wherein PO is propylene oxide, EO is ethylene oxide, and the molar ratio of PO to EO is from about 4:1 to about 5:1; said liquid detergent composition containing no clay suspension agents and having a yield value of from about 100 to about 250.

The following examples illustrate the present invention. It will be appreciated that other modifications of the present invention, within the skill of those in the automatic liquid dishwashing detergency art, can be undertaken without departing from the spirit and scope of this invention.

All parts, percentages, and ratios herein are by weight unless otherwise specified.

EXAMPLE I

Preparation of a compound of the following formula:

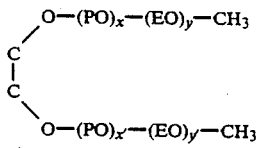

having a molecular weight of about 1900, wherein PO is propylene oxide, EO is ethylene oxide, and the molar ratio of PO to EO is from about 4:1 to about 5:1 , is as follows.

The initiator, ethylene glycol, is reacted first with propylene oxide and then with ethylene oxide under base catalysis with KOH to form the potassium salt of the polyol. This is then reacted with either dimethyl sulfate in the presence of sodium hydroxide or with methyl chloride and $CH_3ONa$ or CH3OK to yield the methyl capped polyalkylene oxide block copolymer nonionic surfactant. This nonionic surfactant is significantly more stable in the presence of chlorine bleach than the uncapped parent molecule.

Other nonionic surfactants of the present invention can be prepared in a similar fashion

EXAMPLE II

A liquid automatic dishwashing detergent composition of the invention is as follows:

| Component | Wt. % |
|---|---|
| Sodium tripolyphosphate (anhydrous basis) | 20.0 |
| Capped polyalkylene oxide block copolymer nonionic surfactant of Example I | 1.0 |
| Sodium carbonate | 6.0 |
| Sodium hydroxide | 0.95 |
| Available chlorine from sodium hypochlorite | 1.0 |
| Sodium silicate solids (2.4R) | 6.54 |
| Polyacrylate thickener-Carbopol 616 | 0.20 |
| Polyacrylate thickener-Carbopol 617 | 0.25 |
| Ethoxylated phosphate ester-Hostophat TP-2253 | 0.20 |
| Lithium hydroxystearate | 1.0 |
| Minor ingredients and water | Balance |

The composition is prepared as follows. The NaOCl, NaOH, sodium silicate, perfume, lithium hydroxystearate, phosphate ester, and water are combined in a stainless steel container which is placed in an ice bath. A Ross mixer is used to high shear mix the contents of the container while adding the sodium tripolyphosphate and the sodium carbonate. Mixing is continued until the particle size is acceptably small, i.e., no visible clumps of sodium tripolyphosphate or sodium carbonate particles can be seen in a thin film of the mixture on a stainless steel spatula. Mixing is continued as the nonionic surfactant is added. Mixing is then stopped and the container is removed from the ice bath. A paddle mixer is then placed into the mixture. The dye is then paddled into the mixture. In a separate container the polycarboxylate polymer is premixed with enough water to moisten the polymer. The polymer slurry (2.5%) is then paddled into the mixture of the other components.

The resulting automatic dishwashing detergent composition has a pH (1% solution) of about 11, a yield value of about 150, and a specific gravity of about 1.32. This detergent composition has bleach stability and enhanced phase stability when compared with similar products thickened with clay or other colloid thickeners. This enhanced phase stability can be seen when the composition of the present invention is stored at 25° C. for four months; no separation out of a liquid phase results. This is comparable to at least 1% separation out of a liquid phase for traditional clay-thickened automatic dishwashing detergent compositions in a much shorter period of time. This detergent also provides superior spotlessness and reduction of filming on dishware and reduced bottle hang-up.

Other compositions of the present invention are obtained when the nonionic surfactant of Example I is replaced with other polyalkylene oxide block copolymer nonionic surfactants having molecular weights between 1000 and 4000 and comprising propylene oxide and ethylene oxide in a molar ratio of from about 4:1 to about 5:1, and being capped with a capping group selected from $C_1$–$C_8$ alkyl, alkyl aryl with an alkyl chain length of $C_1$–$C_8$, aryl alkyl with an alkyl chain length of $C_1$–$C_8$, aryl, and mixtures thereof.

Yet other compositions of the present invention are obtained when the Carbopol polyacrylate thickeners are replaced in whole or in part with polyacrylate polymers sold under the trade names Sokolan PHC-25 ®, available from BASF Corp., or Gantrez ®, available from GAF Corp

What is claimed is:

1. A liquid automatic dishwashing detergent composition comprising:
   (a) hypochlorite bleach to yield available chlorine in an amount of from about 0.1% to about 5%; and
   (b) from about 0.1% to about 5% of a nonionic surfactant having the following structure:

$$I \begin{cases} (AO_1)_x-(AO_2)_y-R \\ ((AO_1)_{x'}-(AO_2)_{y'}-R')_w \end{cases}$$

wherein I is the residue of a compound selected from the group consisting of a monohydroxyl compound, a dihydroxyl compound, and a polyhydroxyl compound; $AO_1$ and $AO_2$ are oxyalkyl groups and one of $AO_1$ and $AO_2$ is propylene oxide with the corresponding x or y being greater than zero, and responding x or y being greater than zero, and the molar ratio of propylene oxide to ethylene oxide is from about 2:1 to about 8:1 ; R and R are selected from the group consisting of alkyl aryl, aryl alkyl, alkyl, aryl, cycloalkyl, and mixtures thereof; w is less than 8 and x' and y' are greater than or equal to zero.

2. The composition of claim 1 wherein I is the residue of a monohydroxyl compound selected from the group consisting of branched and unbranched alcohol groups, an alkyl phenol group, or a dialkyl phenol group.

3. The composition of claim 1 wherein I is the residue of a monohydroxyl compound selected from the group consisting of methanol, ethanol, and butanol; the residue of a dihydroxyl compound selected from the group consisting of ethylene glycol, propylene glycol, butylene glycol, and bisphenol; or the residue of the polyhydroxyl compound selected from the group consisting of glycerine and trimethylolpropane.

4. The composition of claim 1 wherein R and R' are selected from the group consisting of $C_1$–$C_8$ alkyl, alkyl aryl with an alkyl chain length of $C_1$–$C_8$, aryl alkyl with an alkyl chain length of $C_1$–$C_8$, aryl, and mixtures thereof.

5. The composition of claim 4 wherein R and R' are methyl groups.

6. The composition of claim 4 wherein $AO_1$ is propylene oxide, $AO_2$ is ethylene oxide, and the molar ratio of total propylene oxide to total ethylene oxide is from about 3:1 to about 6:1.

7. The composition of claim 6 wherein w is equal to zero and R is a methyl group.

8. The composition of claim 6 wherein w is equal to one and R and R' are methyl groups.

9. The composition of claim 4 wherein $AO_2$ is propylene oxide, $AO_1$ is ethylene oxide, and the molar ratio of total propylene oxide to total ethylene oxide is from about 3:1 to about 6:1.

10. The composition of claim 9 wherein w is equal to zero and R is a methyl group.

11. The composition of claim 9 wherein w is equal to one and R and R′ are methyl groups.

12. The composition of claim 1 wherein the surfactant is:

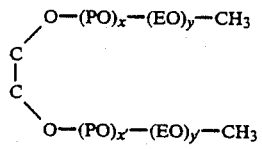

having a molecular weight of about 1900, wherein PO is propylene oxide and EO is ethylene oxide and the molar ratio of PO to EO is from about 4:1 to about 5:1, and mixtures thereof.

13. The composition of claim 1 which additionally comprises from about 5% to about 40% of detergency builder.

14. The composition of claim 13 wherein said detergency builder is selected from the group consisting of sodium tripolyphosphate, sodium carbonate, potassium pyrophosphate, sodium pyrophosphate, and mixtures thereof.

15. The composition of claim 14 which additionally comprises from about 4% to about 10% of sodium silicate.

16. The composition of claim 15 which additionally comprises from about 0.5% to about 1.5% of sodium hydroxide.

17. The composition of claim 14 comprising sodium hypochlorite to yield from about 0.5% to about 2% of available chlorine.

18. The composition of claim 14 additionally comprising a polycarboxylate polymer thickening agent having a molecular weight of from about 500,000 to about 5,000,000; and mixtures thereof.

19. The composition of claim 18 wherein said polycarboxylate polymer thickening agent is selected from the group consisting of polycarboxylate polymers comprising non-linear, water-dispersible, polyacrylic acid cross-linked with a polyalkenyl polyether having a molecular weight between about 750,000 and about 4,000,000; and mixtures thereof.

20. A liquid automatic dishwashing detergent composition comprising:

(a) from about 15% to about 25% of sodium tripolyphosphate;

(b) from about 4% to about 10% of sodium silicate;

(c) from about 3% to about 10% of sodium carbonate;

(d) hypochlorite bleach in an amount to provide from about 0.5% to about 1.5% of available chlorine;

(e) from about 0.2% to about 2% of a polycarboxylate polymer thickening agent selected from the group consisting of polycarboxylate polymers comprising non-linear, water-dispersible, polyacrylic acid cross-linked with a polyalkenyl polyether having a molecular weight of from about 750,000 to about 4,000,000, and mixtures thereof;

(f) from about 0.5% to about 2% of a nonionic surfactant of the following structure:

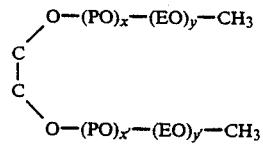

having a molecular weight of about 1900, wherein PO is propylene oxide, EO is ethylene oxide, and the molar ratio of PO to EO is from about 4:1 to about 5:1.

21. The composition of claim 20 containing no clay suspension agents and having a yield value of from about 100 to about 250.

* * * * *

UNITED STATES PATENT AND TRADEMARK OFFICE

CERTIFICATE OF CORRECTION

PATENT NO. : 4,988,452

DATED : January 29, 1991

INVENTOR(S) : George C. Kinstedt, Sherri L. Myers

It is certified that error appears in the above-identified patent and that said Letters Patent is hereby corrected as shown below:

Column 12, line 33, after "and", insert -- the other of $AO_1$ and $AO_2$ is ethylene oxide with the --

Column 12, line 33, "responding" should be -- corresponding --

Signed and Sealed this

Eleventh Day of May, 1993

*Attest:*

Michael K. Kirk

MICHAEL K. KIRK

*Attesting Officer*

*Acting Commissioner of Patents and Trademarks*